United States Patent [19]

Isac

[11] 4,058,337

[45] Nov. 15, 1977

[54] ANIMAL LITTER COLLECTION UNIT

[76] Inventor: Mircea Isac, 59-28 Madison St., Brooklyn, N.Y. 11227

[21] Appl. No.: 738,260

[22] Filed: Nov. 2, 1976

[51] Int. Cl.[2] ..... A47F 13/06

[52] U.S. Cl. ..... 294/19 R; 294/1 R

[58] Field of Search ..... 294/1 R, 19 R, 50.6, 294/50.5, 55; 15/104.8, 257.1, 257.2, 252.6; 56/333, 328, 329, 332; 119/1 R

[56] References Cited

U.S. PATENT DOCUMENTS

| | | | |
|---|---|---|---|
| 3,740,086 | 6/1973 | Rossitto | 294/19 R |
| 3,799,598 | 3/1974 | Lavaggi | 294/1 R |
| 3,901,544 | 8/1975 | Tucciarone | 294/19 R |

*Primary Examiner*—James B. Marbert
*Attorney, Agent, or Firm*—Allen D. Brufsky

[57] ABSTRACT

A collection device for animal feces including a cane-like implement having an inner shaft rotatably mounted in an outer sleeve. An inverted container is slidably mounted on the outer sleeve and a lid for the container is slidably mounted in one terminal end of the inner shaft. The container is slid downwardly on the outer sleeve to cover an animal feces and the lid then rotated to position beneath the container to seal the container. Both the container and lid are then removed from the implement and disposed of.

4 Claims, 3 Drawing Figures

ANIMAL LITTER COLLECTION UNIT

BACKGROUND OF THE INVENTION

This invention relates to a sanitary device for collecting and dispersing of animal feces or litter from sidewalks park areas, or the like.

With the adoption by urban dwellers of pets, particularly dogs, city sidewalks and park areas have become soiled with the animal feces so as to become a hazard to pedestrians, in some instances. As a consequence, ordinances have been enacted requiring pet owners to clean up after their pets or be subject to fines, so that these public areas should remain relatively clean. To comply, the owners must carry cleaning materials or implements when walking their pets to clean up the feces after it has been dropped. This invention provides such a device and one which is sanitary to use, enabling the owner to collect and rapidly dispose of the feces.

SUMMARY OF THE INVENTION

In accordance with the invention, a cane-like implement is provided having a handle at one end and a relatively rotatable outer sleeve and inner shaft. The handle is connected to top of the inner shaft which removably receives a pin, which is semi-cyclindrical in shape, in the bottom thereof. The pin is connected to a rotatable lid having a bevelled or rounded edge. An inverted frusto-conical container is slidable clamped to the outer sleeve of the implement above the lid. The container is slid downward on the outer sleeve to cover the animal feces and the lid rotated to close the bottom of the container shovelling the feces into the container. The container and lid are then disposed of by sliding the container and lid from the clamp into a trash receptacle.

BRIEF DESCRIPTION OF THE DRAWING

Further objects and advantages of the invention will become apparent from the following description and claims, and from the accompanying drawing, wherein:

BRIEF DESCRIPTION OF THE PREFERRED EMBODIMENT

Figure 1:
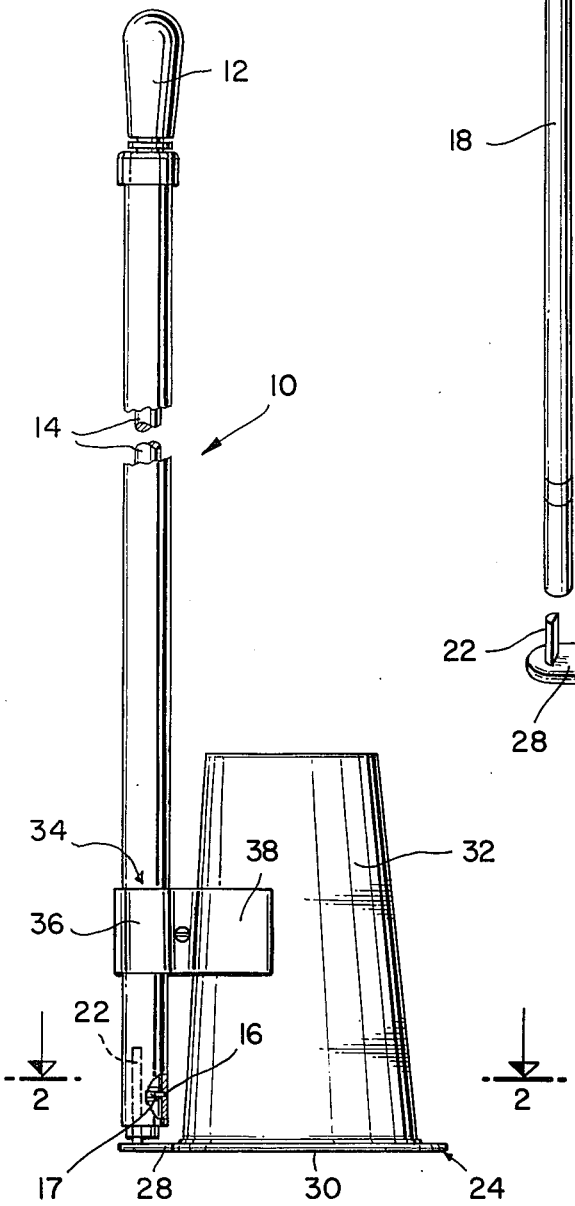
FIG. 1 is a side view in elevation of the collection unit of the present invention.
Figure 3:
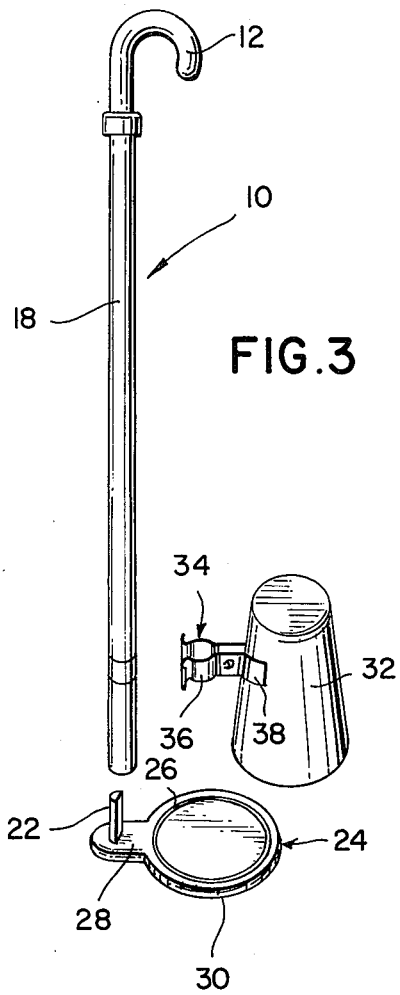
FIG. 3 is an exploded perspective view of the unit illustrated in FIG. 1.
Figure 2:
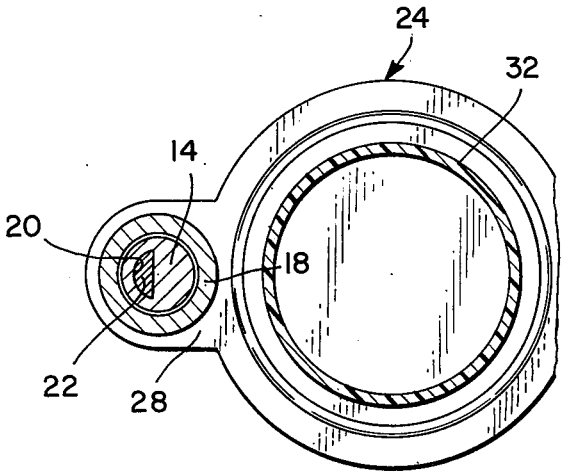
FIG. 2 is a cross-sectional view taken substantially along the plane indicated by line 2—2 of FIG. 1.

Referring now to the drawing in detail, wherein like numerals indicate like elements throughout the several views, the animal litter collection unit 10 of the present invention includes a cane-like implement provided with a hook-shaped handle 12 at its upper end connected to an inner shaft 14 rotatably coupled by a retaining pin 16 received in an annular groove 17 on the bottom of shaft 16 to an outer sleeve 18. Pin 16 is threaded through a a hole in the bottom of outer sleeve 18.

The inner shaft 16 has a semi-cylindrical opening 20 in its bottom terminal end which slidably and removably receives a similarly shaped pin 22 connected to a rotatable lid 24. Lid 24 comprises a cylindrical disc having an annular groove 26 and an extension tab 28 connected to the upright pin 22. The outer edge 30 of lid 24 is rounded or preferably bevelled.

An inverted frusto-conical container 32 is slidably mounted on a double clamp 34. Clamp 34 has a resilient first clamping portion 36 slidable clamped to the outer sleeve 18 of unit 10 and a second C-shaped portion 38 slidably retaining the container 32 on the clamp 34 above lid 24.

In use, container 32 and clamp 34 is slid downwardly on outer sleeve 18 to cover an animal feces. Handle 12 and inner shaft 14 is then rotated relative to sleeve 18 to rotate pin 22, tab 28 and lid 24 beneath the feces and container, the container engaging annular groove 26 in the lid to retain the lid and container together. The bevelled edge 30 of lid 24 enables the lid to be disposed beneath the feces litter with a quick twist of handle 12, simultaneously shovelling the bottom of the feces to a position beneath the container 32. The container 32 and lid 24 are then disposed of by sliding the container and lid sownwardly together from clamp portion 38 and the terminal end of shaft 14 into a suitable trash receptacle.

Because of the shape of the cane-like implement, it can be conveniently carried and used as a cane when walking a dog on a leash and will seem inconspicuous.

While a specific embodiment of an animal litter collection unit has been disclosed in the foregoing description, it will be understood that various modifications within the spirit of the invention may occur to those skilled in the art. Therefore, it is intended that no limitations be placed on the invention except as defined by the scope of the appended claims.

I claim:

1. An animal litter collection unit comprising:

an upright cane-like implement having an inner shaft telescopically received within an outer tubular sleeve, means rotatably securing said inner shaft to said outer sleeve, said inner shaft having a handle at one end thereof for carrying said implement and for rotating said inner shaft relative to said outer sleeve, an inverted container, means slidably connecting said inverted container to said outer sleeve, a lid for said container, and means slidably mounting said lid to the other end of said inner shaft so it can be rotated to a position beneath said container and removed along with said container from said cane-like implement upon rotation of said inner sleeve and downward sliding movement of said container, said means slidably connecting said inverted container to said outer sleeve including a double clamp, said clamp having a first portion slidably mounted on said outer sleeve, and a second portion slidably retaining said container.

2. The unit of claim 1 wherein said means rotatably securing said inner shaft to said outer sleeve includes an annular groove on said inner shaft and a locking pin received in said groove removable mounted on said outer sleeve.

3. The unit of claim 1 wherein said means slidably and rotatably mounting said lid on said inner shaft includes a tab extending laterally from said lid, and an upright semi-cylindrical pin fixed to said tab slidably received in a complementally shaped opening in the bottom of said inner shaft.

4. The unit of claim 1 wherein said lid includes an annular groove to receive the lower edge of said container.

* * * * *